US006380837B1

(12) United States Patent
Lindquist

(10) Patent No.: US 6,380,837 B1
(45) Date of Patent: Apr. 30, 2002

(54) SLOW ACTING FUSE WITH WIDE RANGE OF CURRENT RATINGS

(75) Inventor: Carl E. Lindquist, Bridgewater, NJ (US)

(73) Assignee: San-O-Industrial Corporation, Holbrook, NY (US)

( * ) Notice: Subject to any disclaimer, the term of this patent is extended or adjusted under 35 U.S.C. 154(b) by 136 days.

(21) Appl. No.: 09/598,066

(22) Filed: Jun. 20, 2000

(51) Int. Cl.[7] ..... H01H 85/30; H01H 85/12

(52) U.S. Cl. ..... 337/164; 337/165; 337/163; 337/267

(58) Field of Search ..... 337/265, 186–188, 337/208–210, 216, 256, 267, 163, 164, 165; 200/61.08; 361/104; 116/216, 217

(56) References Cited

U.S. PATENT DOCUMENTS 2,563,812 A * 8/1951 Berthel ..... 200/123
2,988,620 A * 6/1961 Kozacka ..... 200/131
3,190,987 A * 6/1965 Fister ..... 200/121
3,538,480 A * 11/1970 Urani ..... 337/187
3,810,062 A * 5/1974 Kozacka ..... 337/161
4,496,929 A * 1/1985 Urani ..... 337/265
5,111,176 A * 5/1992 Lindquist ..... 337/188
5,276,422 A * 1/1994 Ikeda et al. ..... 337/28
6,064,292 A * 5/2000 Pongracz ..... 337/224

FOREIGN PATENT DOCUMENTS

JP 7-57616 * 3/1995 ..... H01H/85/12

* cited by examiner

*Primary Examiner*—Lynn D. Feild
*Assistant Examiner*—Anatoly Vortman

(57) ABSTRACT

A fuse assembly is provided having two fusible elements, electrically in parallel with each other, thereby providing the fuse assembly with increased inrush current withstand capacity, a greater range of current ratings and lower temperature rise at higher rated currents.

24 Claims, 1 Drawing Sheet

SLOW ACTING FUSE WITH WIDE RANGE OF CURRENT RATINGS

FIELD OF THE INVENTION

This invention relates generally to fuses and is particularly related to slow acting fuses having a wide range of current ratings. More specifically, the present invention relates to an alarm indicating or non-alarm indicating fuse which, due to its improved element components and configuration, results in a fuse with higher current ratings than available in the prior art, and that can withstand significant current inrush (surge) without opening the circuit while continuing to protect the circuit at a predetermined current overload.

BACKGROUND OF THE INVENTION

It is well known that fuses provide means for protecting electric and electronic circuits against damage due to current overload by opening the circuit when the electrical current passing through the fuse exceeds the fuse's predetermined rated current carrying capacity. A variety of alarm indicating and non-alarm indicating fuses with different current rated values are presently in use. Each alarm indicating fuse comprises a fusible element, usually metallic, which melts when the power consumed by the fuse raises its element temperature above the melting point of the fusible metal element. The physical disconnect during opening of the element between the current load terminal and current source (often referred to as "battery") terminal permits a spring loaded contact to be disconnected from the current load and reconnects this same current source to an alarm terminal, providing a local and remote alarm indication that the fuse (and the circuit) has opened. Similarly, a non-alarm indicating fuse comprises the same construction, without the spring loaded contacts. There are many examples of such prior art fuses. Prior designs of alarm type fuses have restricted the element to a single, fast acting, type of current overload device. This has also limited the maximum current rating possible due to the high energy being transferred through—and associated heat developed in—a single element.

Single element fuses which are in common use have inherent current rating limitations. The use of a single fusible element in this fuse type with current rating of over 15 amperes often results in overheating of the fusible element which causes damage to the fuse, fuseholder and potentially the circuit itself. In some circuits, however, alarm type fuses having a surge withstand capability and current ratings in excess of 15 amperes are required. While this capacity is possible in some fuses, e.g., the well known cartridge fuses, it is common to add a second, parallel fusible element in order to provide a fuse with higher surge withstand and slower operating speed. These two fusible elements are typically made of the same material and have the same cross section. However, these are not of the same mechanical configuration, are not alarm indicating fuses and the prior art alarm indicating fuses do not permit such construction. Therefore, there is a need for this type fuse which is slower acting, which can withstand a surge of current without opening, have higher current ratings and will continue to protect the fuse, fuseholder and circuit components against over current and heat damage.

Accordingly, it is an object of this invention to provide an alarm indicating fuse with enhanced characteristics for protecting electric and electronic circuits.

It is a further object of this invention to provide an alarm indicating fuse or non-alarm indicating fuse having improved characteristics because of its higher current rating.

It is also an object of this invention to provide a non-alarm indicating fuse or alarm indicating fuse with a wider range of current ratings which is slow acting and can withstand a surge of electric current without nuisance opening, thus protecting the fuse, fuseholder and circuit against damage and deterioration while permitting the circuit to receive adequate energy to perform its designated functions.

The foregoing and other objects of the present invention will be more clearly understood from the ensuing description of the invention and the accompanying drawings.

SUMMARY OF THE INVENTION

In accordance with the present invention an alarm indicating fuse assembly is provided comprising two fusible elements disposed electrically in parallel relative to each other. It has been discovered that by using a fuse assembly having two fusible elements in parallel, rather than one fusible element as it is now the conventional practice, the alarm indicating fuse assembly can withstand significantly greater current inrush without nuisance opening, and will permit production of alarm indicating fuses having higher current ratings, as compared to a similar fuse assembly which has only one fusible element.

The novel fuse assembly of this invention comprises an insulative body portion having a top portion and lower portion. The lower body portion has a vertical edge terminating in a first electrically conductive terminal and a sloped edge having an arcuate lower portion terminating in a second electrically conductive terminal. The lower body portion has a front surface and a rear surface, a diagonal groove in one of said surfaces and a first fusible element disposed in said groove. The first fusible element has one of its ends connected to the first electrically conductive terminal and a second end connected to an alarm member (e.g., an alarm contact and spring). The alarm member has a free upper end and a lower end connected to the second electrically conductive terminal. In the improvement which defines the novel fuse assembly of this invention, a second fusible element is stretched between, and its respective ends are electrically in contact, respectively, with the first and second contact terminals.

In a second embodiment of the present invention, the fuse assembly is substantially similar in structure as the first embodiment except that the second fusible element is encased within an electrically insulative tube, such as, e.g., a ceramic tube, in order to restrict arcing and improve safety of operation of the fuse assembly.

In a third embodiment of the present invention, the fuse assembly is substantially similar in structure as the first embodiment except that the first fusible element is connected to a second contact terminal that is not spring loaded and, therefore, will not be employed as an alarm indicator.

In a fourth embodiment of the present invention, the fuse assembly is substantially similar in structure as the second embodiment except that the first fusible element is connected to a second contact terminal that is not spring loaded and, therefore, will not be employed as an alarm indicator.

BRIEF DESCRIPTION OF THE DRAWINGS

In the drawings, wherein like reference numerals are employed to designate like parts.

DETAILED DESCRIPTION OF THE DIFFERENT EMBODIMENTS OF THE INVENTION

Figure 2:
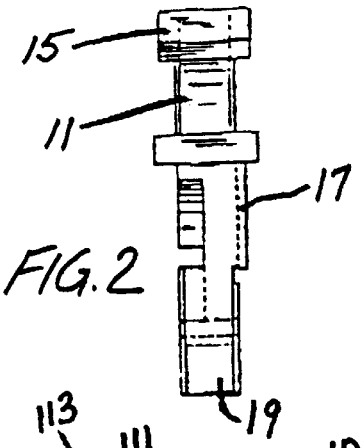
FIG. 2 is a front elevational view of the fuse shown in FIG. 1.
Figure 1:
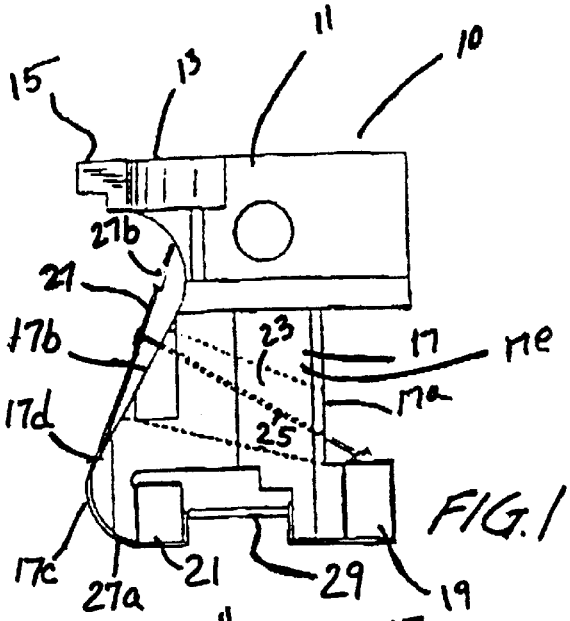
FIG. 1 is a side elevational view of a fuse made according to one embodiment of this invention.

Referring to FIG. 1, there is shown a fuse assembly generally designated as 10 having a body portion 11 stamped or molded in one piece from a suitable insulative plastic material such as, for example polyphenylene sulfide (PPS). The body portion 11 has an upper portion 13 with a laterally extending segment 15, and a lower flat portion 17 having a vertical side 17*a* and a downwardly extending sloped side 17*b* laterally opposite the vertical side 17*a*. The vertically extending side 17*a* terminates in a generally L-shaped portion having a laterally projecting contact terminal 19 which is covered by a suitable plated conductive metal such as copper, phosphor-bronze, beryllium-copper, etc. The sloped side 17*b* has an arcuate lower portion 17*c* which terminates in a second metal-covered contact terminal 21 which projects inwardly toward, and in spaced relation to the metal-covered contact terminal 19. The lower body portion 17 comprises opposed front and rear surfaces 17*d* and 17*e* and a diagonally extending groove 23 is disposed in said rear surface 17*e* for accommodating a first fusible element 25 which is attached to and extends from the contact terminal 19 diagonally in said groove 23 toward the spring alarm indicator 27, and is attached to the alarm indicator 27 such as, e.g., by soldering at about midway of said alarm indicator spring. As shown in FIG. 1, the alarm indicator 27 has one end 27*a* attached to the contact terminal 21 with its other color code beaded end 27*b* free to be released out of its normal position when the current rated capacity of the fuse is exceeded thus causing the fusible element 25 to melt. As seen from FIG. 1, the downwardly extending sloped side 17*b* defines a generally S-shaped configuration between the lateral segment 15 and the contact terminal 21 such that the free end 27 of the spring alarm indicator 27*b* is biased away from the sloped side 17*b* thus signaling opening of the fuse.

As it was previously mentioned, fuses having one fusible element exhibit limited tolerance when a surge of current passes through the fuse and thus they open quickly. In accordance with this invention, and as shown in FIG. 1, a second fusible element is incorporated into the fuse assembly electrically in parallel with the first fusible element. Thus, referring again to FIG. 1, a second fusible element 29 is employed by attaching its respective ends to the metal covered contact terminals 19 and 21, respectively, electrically in parallel with the first fusible element 25. It has been discovered that by maintaining the first fusible element at approximately the same current rating as the second fusible element a maximum surge withstand or slowing of operation can be obtained. Similarly, by making either of the two elements a much greater current rating than the other, the operating speed of the fuse at a given overload can be increased to that approaching a single element design. Between these two described conditions are an infinite number of first and second element combinations that can be employed to reproduce a specific operating characteristic (e.g., fuse speed and/or surge withstand) with a high degree of precision. Because the fuse current is divided into two paths with this new design, and because the second element can be a relatively low resistance enclosed element (FIG. 3, 129), the slower operation and higher current ratings may be obtained without sacrificing other important fuse parameters, such as the overall voltage rating, interrupting current rating and maximum allowable temperature rise.

Figure 3:
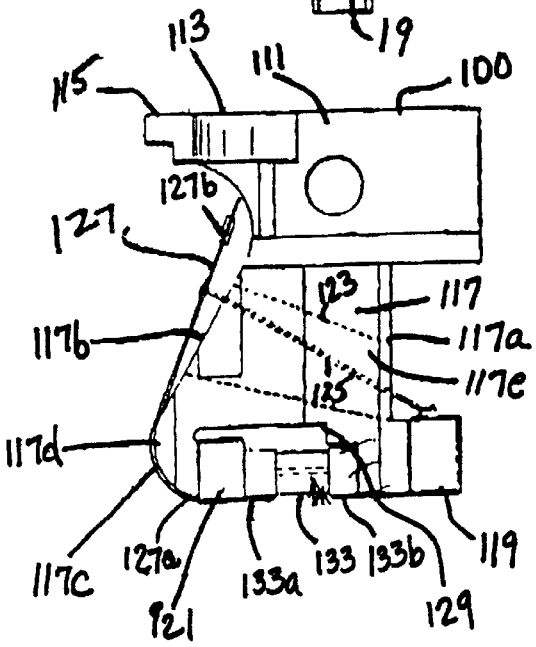
FIG. 3 is a side elevational view of a fuse made according to another embodiment of the present invention.

The fuse assembly described in FIGS. 1 or 3 permits the use of a higher conductivity metal (e.g., silver) as the second fusible element without concern for the relative tensile strength of the secondary fusible element. By contrast, tensile strength of the primary element must be maintained at a level sufficient to insure that the continued spring force being applied by the alarm spring does not elongate the element over time and under normal electric current conditions. Tensile strength is typically inversely proportional to electrical conductivity. For example, a silver element has a very high conductivity, but silver has insufficient tensile strength to prevent stretching over time and under a spring force load. Thus, the novel fuse assembly of this invention permits the use of a second fusible element with markedly lower resistance, and hence considerably less heat generation as compared to the use of a single fusible element having the same current rating.

FIG. 3 shows a fuse assembly 100 which is similar to the fuse assembly shown in FIG. 1 except that the second fusible element is an enclosed element. Thus, the fusible assembly 100 comprises a body portion 111 as in the fuse assembly shown in FIG. 1. The body portion 111 has an upper portion 113 with a laterally extending segment 115 and a lower flat portion 117 having a vertical side 117*a* and a downwardly extending sloped side 117*b* laterally opposite and spaced relative to the vertical side 117*a*. The vertically extending side 117*a* terminates in a generally L-shaped portion having a laterally projecting contact terminal 119 which is covered with a suitably plated conductive metal such as copper, phosphor-bronze, beryllium-copper, etc. The sloped side 117*b* includes an arcuate lower portion 117*c* which terminated in a second metal-covered contact terminal 121 which projects inwardly toward and, is in spaced relation to the metal covered contact terminal 119. The lower body 117 comprises opposed front and rear surfaces 117*d* and 117*e* for accommodating a first fusible element 125 which is connected to and extends from the contact terminal 119 diagonally in said groove 123 toward the spring alarm indicator 127 and is attached thereto, e.g., by soldering at about midway of said alarm indicator spring. The alarm indicator has its end 127*a* connected to the contact terminal 121 with its other color code beaded end 127*b* free to be released out of its normal position when the current rated capacity of the fuse is exceeded thus causing the fusible element 125 to melt. As in the embodiment shown in FIG. 1, the downwardly extending sloped side 117*b* defines a generally S-shaped configuration between the lateral segment 115 and the contact terminal 121 such that the free end 127 of the spring alarm indicator 127*b* is biased away from the sloped side 117*b* thus signaling opening of the fuse.

Also, as in the embodiment described with reference to FIG. 1, and in order to improve the current rated capacity of the fuse, a second fusible element 129 is employed electrically in parallel with the first fusible element 125 as shown in the embodiment described in FIG. 3. In this embodiment however, the second fusible element 129 is encased within an insulative tubing such as a ceramic tubing 133 in order to prevent arcing and improve safety of operation and use of the fuse assembly. The ceramic tubing 133 is capped at both ends with conductive metal caps 133*a*, 133*b* which are attached electrically and mechanically to the primary fuse terminals 121 and 119, respectively, by suitable means.

The advantages associated with the fuse described in the embodiment of FIG. 3 are the same as noted above for the fuse described in the embodiment of FIG. 1, except the secondary element is fully enclosed resulting in a final fuse assembly that will provide for higher current ratings, higher voltage ratings, higher interruption current ratings and a lower probability of damage to the fuse, fuseholder or circuit.

Figure 4:
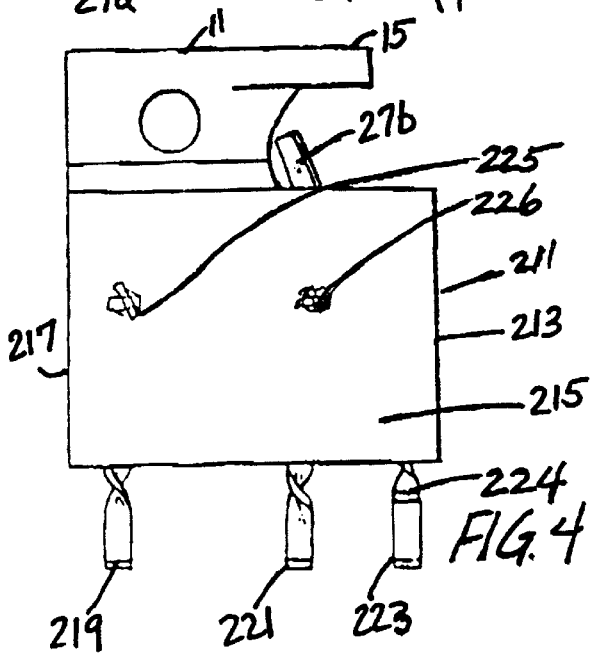
FIG. 4 is a side elevational view of a fuseholder with a fuse mounted therein, the fuse being either of the embodiments shown in FIGS. 1 or 3.

Both fuse assemblies which have hereinbefore been described can be conveniently used with the fuse holder shown in FIG. 4. The fuse holder shown in FIG. 4 is described in U.S. Pat. No. 5,111,176 issued May 5, 1992, to Carl E. Lindquist, the inventor herein, and is assigned to San-O Industrial Corporation, Holbrook, N.Y., the disclosure of which is fully incorporated herein by reference. As shown in FIG. 4, the fuseholder 211 comprises a fuseholder body 213 having a front wall or side 215 and a rear wall or side 217. The fuseholder 211 has contacting pins 219, 221, 223, 224, 225 and 226 which can be inserted in corresponding apertures on the surface of a printed circuit board (PCB not shown) and is secured therein, e.g., by soldering. The fuse assembly, e.g., the fuse assembly 10 of FIG. 1, is thus mounted in the fuseholder 211 by inserting the fuse assembly through a slot located at the top of the fuseholder body (not shown).

While the fuse assemblies of FIGS. 1 and 3 have been described with a certain degree of particularity, it can be appreciated, and therefore understood, that several changes may be made in their structure which are obvious from the foregoing description and are therefore within the scope of the present invention. Such variations include the same fuse construction as shown in FIGS. 1 and 3, but without a spring loaded contact at one end of the primary element.

Thus, in these variations of the invention the spring alarm indicator 27*b* in FIG. 1, and the spring alarm indicator 127*b* in FIG. 3 are eliminated. Accordingly, in FIG. 1, the fusible element 23 will still have one end electrically connected to the contact terminal 19 and its other end is connected to what is now an electrically conductive extension 27 of the second electrically conductive contact terminal 21. Similarly, In the variation of the invention illustrated in FIG. 3, the spring alarm indicator 127*b* is eliminated. Thus, the fusible element 123 will have one end electrically connected to the contact terminal 119 and its other end connected to what is now an electrically conductive extension 127 of the second electrically conductive contact terminal 121.

What is claimed is:

1. A fuse assembly comprising an insulative body portion said body portion having a top portion and a lower portion, said lower portion having two edges, a vertical edge and a sloped edge spaced laterally relative to said vertical edge, said vertical edge terminating in a first, conductive terminal, and said sloped edge terminating in a second, conductive terminal spaced-apart relative to said first, conductive terminal, said lower portion having a front surface and a rear surface, a diagonally extending groove in one of said surfaces, a first fusible element disposed diagonally in said groove, said fusible element having two ends, a flexible alarm member having two ends, a first lower end connected to said second, conductive terminal and a second free end, one end of said fusible element being connected to said flexible alarm member, and said second end of said fusible element being electrically connected to said first, conductive terminal, and a second fusible element electrically in parallel with said first fusible element, having two ends, one of said ends being connected to said first, conductive terminal and said second end being connected to said second, conductive terminal.

2. A fuse assembly as in claim 1 wherein said first fusible element is made of a conductive metal having higher tensile strength than the metal of said second, fusible element.

3. A fuse assembly as in claim 1 wherein said first fusible element has a lower current rating than the current rating of the second fusible element.

4. A fuse assembly as in claim 1 wherein said first fusible element has a higher current rating than the current rating of the second fusible element.

5. A fuse assembly as in claim 1 wherein said first fusible element has a current rating equal to the current rating of the second fusible element.

6. A fuse assembly as in claim 2 wherein said first fusible element has a lower current rating than the current rating of the second fusible element.

7. A fuse assembly as in claim 2 wherein said first fusible element has a higher current rating than the current rating of the second fusible element.

8. A fuse assembly as in claim 2 wherein said first fusible element has a current rating equal to the current rating of the second fusible element.

9. A fuse assembly comprising an insulative body portion said body portion having a top portion and a lower portion, said lower portion having two edges, a vertical edge and a sloped edge spaced laterally relative to said vertical edge, said vertical edge terminating in a first, conductive terminal, and said sloped edge terminating in a second, conductive terminal spaced-apart relative to said first, conductive terminal, said lower portion having a front surface and a rear surface, a diagonally extending groove in one of said surfaces, a first fusible element disposed diagonally in said groove, said fusible element having two ends, a flexible alarm member having two ends, a first lower end connected to said second, conductive terminal and a second free end, one end of said fusible element being connected to said flexible alarm member, and said second end of said fusible element being electrically connected to said first, conductive terminal and a second fusible element electrically in parallel with said first fusible element, enclosed within an insulative tubular member having electrically conductive end closure members, a first end closure member connected to said first, conductive terminal and said second end closure member being connected to said second, conductive terminal.

10. A fuse assembly as in claim 9 wherein said first fusible element is made of a conductive metal having a higher tensile strength than the metal of said second, fusible element.

11. A fuse assembly as in claim 9 wherein said first fusible element has a lower current rating than the current rating of said second fusible element.

12. A fuse assembly as in claim 9 wherein said first fusible element has a higher current rating than the current rating of said second fusible element.

13. A fuse assembly as in claim 9 wherein said first fusible element has a current rating equal to the current rating of the second fusible element.

14. A fuse assembly as in claim 10 where said first fusible element has a lower current rating than the current rating of the second fusible element.

15. A fuse assembly as in claim 10 wherein said first fusible element has a higher current rating than the current rating of the second fusible element.

16. A fuse assembly as in claim 10 wherein said first fusible element has current rating equal to the equal to the current rating of the second fusible element.

17. A fuse assembly comprising an insulative body portion said body portion having a top portion and a lower portion, said lower portion having two edges, a vertical edge and a sloped edge spaced laterally relative to said vertical edge, said vertical edge terminating in a first, conductive terminal and said sloped edge terminating in a second, conductive terminal spaced-apart relative to said first, conductive terminal, said lower portion having a front surface and a rear surface, a diagonally extending groove in one of said surfaces, a first fusible element exposed in said groove, said fusible element having two ends, one end of said fusible element being electrically connected to said first, conductive terminal with the opposite end of said first fusible element electrically connected to a conductive extension of said second conductive terminal, and a second fusible element electrically in parallel with said first fusible element, having two ends, one of said ends being connected to said first, conductive terminal and said second end being connected to said second, conductive terminal.

18. A fuse assembly as in claim 17 wherein said first fusible element has a lower current rating than the current rating of the second fusible element.

19. A fuse assembly as in claim 17 wherein said first fusible element has a higher current rating than the current rating of the second fusible element.

20. A fuse assembly as in claim 17 wherein said first fusible element has a current rating equal to the current rating of the second fusible element.

21. A fuse assembly comprising an insulative body portion said body portion having a top portion and a lower portion, said lower portion having two edges, a vertical edge and a sloped edge spaced laterally relative to said vertical edge, said vertical edge terminating in a first, conductive terminal and said sloped edge terminating in a second, conductive terminal spaced-apart relative to said first, conductive terminal, said lower portion having a front surface and a rear surface, a diagonally extending groove in one of said surfaces, a first fusible element exposed in said groove, said fusible element having two ends, one end of said fusible element being electrically connected to said first, conductive terminal with the opposite end of said first fusible element electrically connected to a conductive extension of said second conductive terminal, and a second fusible element electrically in parallel with said first fusible element, enclosed within an insulative tubular member having electrically conductive end closure members, a first end closure member connected to said first, conductive terminal and said second end closure member being connected to said second, conductive terminal.

22. A fuse assembly as in claim 21 wherein said first fusible element has a lower current rating than the current rating of the second fusible element.

23. A fuse assembly as in claim 21 wherein said first fusible element has a higher current rating than the current rating of the second fusible element.

24. A fuse assembly as in claim 21 wherein said first fusible element has a current rating equal to the current rating of the second fusible element.

* * * * *